US011411322B2

(12) United States Patent
Sharawi et al.

(10) Patent No.: US 11,411,322 B2
(45) Date of Patent: Aug. 9, 2022

(54) CONCENTRIC PENTAGONAL SLOT BASED MIMO ANTENNA SYSTEM

(71) Applicant: King Fahd University of Petroleum and Minerals, Dhahran (SA)

(72) Inventors: Mohammad S. Sharawi, Dhahran (SA); Rifaqat Hussain, Dhahran (SA)

(73) Assignee: King Fahd University of Petroleum and Minerals, Dhahran (SA)

( * ) Notice: Subject to any disclaimer, the term of this patent is extended or adjusted under 35 U.S.C. 154(b) by 0 days.

(21) Appl. No.: 16/002,758

(22) Filed: Jun. 7, 2018

(65) Prior Publication Data

US 2019/0379135 A1 Dec. 12, 2019

(51) Int. Cl.

| | |
|---|---|
| ***H01Q 1/24*** | (2006.01) |
| ***H01Q 21/06*** | (2006.01) |
| ***H01Q 13/10*** | (2006.01) |
| ***H01Q 1/48*** | (2006.01) |

(52) U.S. Cl.

CPC ..... *H01Q 21/064* (2013.01); *H01Q 1/243* (2013.01); *H01Q 1/48* (2013.01); *H01Q 13/103* (2013.01)

(58) Field of Classification Search

CPC ..... H01Q 21/28; H01Q 21/064; H01Q 5/321; H01Q 9/0421; H01Q 9/0442; H01Q 1/243; H01Q 1/521; H01Q 1/48; H01Q 13/103

See application file for complete search history.

(56) References Cited

U.S. PATENT DOCUMENTS

| | | | | |
|---|---|---|---|---|
| 4,208,660 | A * | 6/1980 | McOwen, Jr. | H01Q 9/0435 343/769 |
| 6,583,765 | B1 * | 6/2003 | Schamberger | H01Q 13/106 343/770 |
| 7,852,269 | B2 | 12/2010 | Tsutsui et al. | |
| 8,803,750 | B2 | 8/2014 | Van Gils | |
| 2003/0222824 | A1 * | 12/2003 | Louzir | H01Q 1/38 343/767 |
| 2004/0227683 | A1 * | 11/2004 | Caimi | H01Q 1/36 343/742 |
| 2014/0145895 | A1 * | 5/2014 | Chen | H01Q 9/285 343/795 |
| 2017/0141465 | A1 * | 5/2017 | Sharawi | H01Q 1/48 |

FOREIGN PATENT DOCUMENTS

| | | |
|---|---|---|
| CN | 106816703 A | 6/2017 |
| EP | 0 889 543 A1 | 1/1999 |

OTHER PUBLICATIONS

Deepali K. Borakhade, et al., "Pentagon Slot Resonator Frequency Reconfigurable Antenna for Wideband Reconfiguration", AEU—International Journal of Electronics and Communications, vol. 69, Issue 10, Oct. 2015, pp. 1562-1568.

* cited by examiner

*Primary Examiner* — Awat M Salih

(74) *Attorney, Agent, or Firm* — Oblon, McClelland, Maier & Neustadt, L.L.P.

(57) ABSTRACT

Aspects of the disclosure provide an antenna system. The antenna system can include a dielectric substrate that has a top surface and a bottom surface covered by a ground plane, and four identical antenna elements symmetrically distributed on each corner of the bottom surface. Each antenna element can have a concentric-pentagonal-slot-based structure that is etched out of the ground plane, and includes an outer pentagonal slot and an inner pentagonal slot. Each side of the outer pentagonal slot can be parallel with a corresponding side of the inner pentagonal slot.

10 Claims, 4 Drawing Sheets

CONCENTRIC PENTAGONAL SLOT BASED MIMO ANTENNA SYSTEM

BACKGROUND

Field of the Disclosure

The disclosure relates to reconfigurable multiple-input multiple-output (MIMO) antenna systems for compact wireless devices.

Description of the Related Art

New features and services are continuously added to wireless systems resulting in tremendous increase in data rate and spectrum efficiency requirements. New wireless communication standards are developed and implemented resulting in coexistence of multiple frequency bands distributed over a very wide frequency range. To design an antenna system that covers multiple wireless standards and meet high data rate and spectrum efficiency requirements is a formidable challenge. Multiple-input multiple-output (MIMO) and frequency agile antennas together with cognitive radio (CR) techniques can be employed to address the challenge. CR is an adaptive, intelligent radio and network technology that can automatically detect available channels in a wireless spectrum, and change transmission parameters enabling more communications to run concurrently. It is desirable to use wide-tuning band frequency reconfigurable MIMO antenna systems in future CR based applications.

A front end of a CR system can include two antennas: an ultra-wide-band (UWB) sensing antenna, and a reconfigurable communication antenna. The UWB antenna is used to sense the entire spectrum of interest while the reconfigurable antennas are used to dynamically change the basic radiating characteristics of the antenna system to utilize available spectrum resources. MIMO antenna systems can be adopted to increase wireless channel capacity and data transmission reliability. A key feature of an MIMO antenna system is its ability to multiply data throughput with enhanced data reliability using an available bandwidth, thus resulting in improved spectral efficiency.

Accordingly, it is one objective of the resent disclosure to provide a compact, multi-wideband tuning antenna system that is tuned over an ultra-wide frequency band and provides smooth variation of the resonance frequencies and is suitable to be used in wireless handheld devices and mobile terminals for cognitive radio (CR) applications.

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present invention.

SUMMARY

The foregoing paragraphs have been provided by way of general introduction, and are not intended to limit the scope of the following claims. The described embodiments, together with further advantages, will be best understood by reference to the following detailed description taken in conjunction with the accompanying drawings.

Aspects of the disclosure provide an antenna system. The antenna system can include a dielectric substrate having a bottom surface that is covered by a ground plane, and a top surface, and four identical antenna elements symmetrically distributed on each corner of the bottom surface. Each antenna element can have a concentric-pentagonal-slot-based structure that is etched out of the ground plane, and includes an outer pentagonal slot and an inner pentagonal slot. Each side of the outer pentagonal slot can be parallel with a corresponding side of the inner pentagonal slot.

In an embodiment, the antenna system can further include a first and a second varactor diode for each of the four antenna elements. The first varactor diode is disposed across the outer pentagonal slot of the respective antenna element, and the second varactor diode is disposed across the inner pentagonal slot of the respective antenna element. In one example, the antenna system further includes a biasing circuit for each of the four antenna elements configured to provide a bias voltage to the respective first and second varactor diodes. In an alternative example, the antenna system includes a first and second biasing circuit for each of the four antenna elements configured to provide bias voltages to the respective first and second varactor diodes.

In an embodiment, the antenna system further includes a varactor diode for each of the four antenna elements. A capacitance of the varactor diode is loaded to an outer and an inner pentagonal slot of the respective antenna element.

In an embodiment, one side of the outer pentagonal slot of each antenna element is parallel with a shorter edge of the dielectric substrate with a center of the respective antenna element positioned between the one side and the shorter edge. In a first example, the antenna system can further include a first and a second varactor diode for each of the four antenna elements. The first varactor diode is disposed across the one side of the outer pentagonal slot of the respective antenna element, and the second varactor diode is disposed across the side of the inner pentagonal slot of the respective antenna element that is parallel with the one side.

In a second example, the antenna system can include a varactor diode for each of the four antenna elements. A capacitance of the varactor diode is loaded across the one side of the outer pentagonal slot of the respective antenna element, and the side of the inner pentagonal slot of the respective antenna element that is parallel with the one side.

In an embodiment, the antenna system can further include two defected ground structures (DGS) each disposed between two antenna elements disposed along a shorter edge of the substrate, and etched out of the ground plane. In one example, each of the two DGS includes two parallel slots extending away from a patch positioned at the respective shorter edge.

In an embodiment, the antenna system further includes four microstrip feed lines on the top surface corresponding to each antenna elements. In one example, each of the four microstrip feed lines extends from a shorter edge of the dielectric substrate and reaches a position above an area within the inner pentagonal slot.

In an embodiment, the dielectric substrate is an FR-4 substrate with a relative permittivity of 4.4 and a loss tangent of 0.002. In an embodiment, the dielectric substrate has a size of 60×120 mm2. In an embodiment, the inner diagonal slot has a side length of 8.3 mm, and the outer diagonal slot has a side length of 14.2 mm. In an embodiment, a distance between a center of the concentric-diagonal-slot-based structure of each antenna element and a shorter edge of the dielectric substrate is 20.6 mm. In an embodiment, a resonant frequency of the antenna system is configured to change over a frequency band from 1.32 GHz to 5.2 GHz with a minimum −6 dB bandwidth of 50 MHz.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF EMBODIMENTS

Figure 1B:
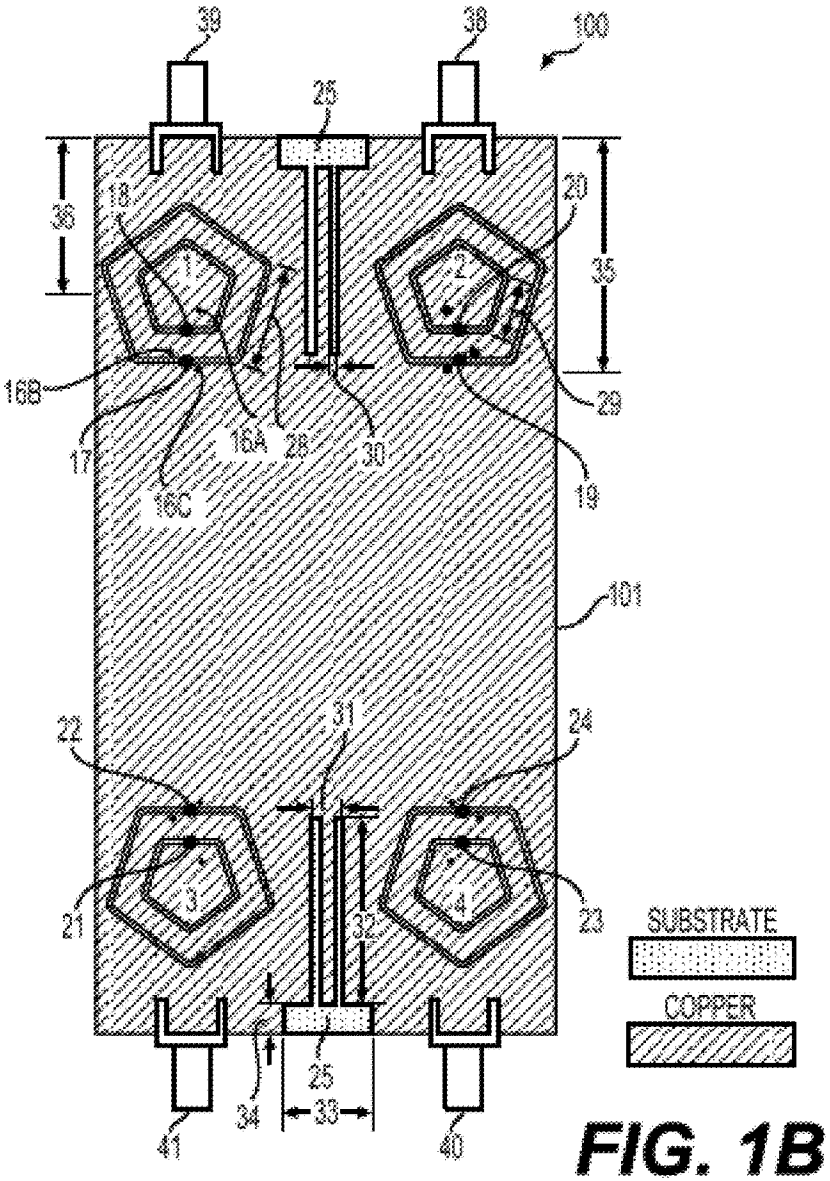
FIG. 1B is a bottom view of the example antenna system according to the embodiment of the disclosure.

The description set forth below in connection with the appended drawings is intended as a description of various embodiments of the disclosed subject matter and is not necessarily intended to represent the only embodiment(s). In certain instances, the description includes specific details for the purpose of providing an understanding of the disclosed subject matter. However, it will be apparent to those skilled in the art that embodiments may be practiced without these specific details. In some instances, well-known structures and components may be shown in block diagram form in order to avoid obscuring the concepts of the disclosed subject matter.

Reference throughout the specification to "one embodiment" or "an embodiment" means that a particular feature, structure, characteristic, operation, or function described in connection with an embodiment is included in at least one embodiment of the disclosed subject matter. Thus, any appearance of the phrases "in one embodiment" or "in an embodiment" in the specification is not necessarily referring to the same embodiment. Further, the particular features, structures, characteristics, operations, or functions may be combined in any suitable manner in one or more embodiments. Further, it is intended that embodiments of the disclosed subject matter can and do cover modifications and variations of the described embodiments.

It must be noted that, as used in the specification and the appended claims, the singular forms "a," "an," and "the" include plural referents unless the context clearly dictates otherwise. That is, unless clearly specified otherwise, as used herein the words "a" and "an" and the like carry the meaning of "one or more." Additionally, it is to be understood that terms such as "left," "right," "top," "bottom," "front," "rear," "side," "height," "length," "width," "upper," "lower," "interior," "exterior," "inner," "outer," and the like that may be used herein, merely describe points of reference and do not necessarily limit embodiments of the disclosed subject matter to any particular orientation or configuration. Furthermore, terms such as "first," "second," "third," etc., merely identify one of a number of portions, components, points of reference, operations and/or functions as described herein, and likewise do not necessarily limit embodiments of the disclosed subject matter to any particular configuration or orientation.

Embodiments of a concentric-pentagonal-slot-based frequency reconfigurable multiple-input multiple-output (MIMO) antenna system are described in the present disclosure. The antenna system can include 4 identical antenna elements fabricated on a dielectric substrate, such as a commercially available FR-4 substrate with dimensions $60\times120\times1.56$ mm$^3$. Frequency reconfigurability is achieved by reactively loading dual pentagonal slots of the antenna system using varactor diodes. For example, the antenna elements can be effectively loaded with active impedance to properly operate over an ultra-wide frequency band. Smooth variation of the resonance frequencies are observed from 1.32 to 5.2 GHz, covering operating bands of several well-known wireless standards such as GSM, PCS, UMTS, LTE and New Radio. The antenna system is compact and planar in structure, and thus is suitable for wireless handheld devices and mobile terminals with cognitive radio (CR) capabilities. In alternative embodiments, the antenna system may include different number (e.g., 3 or 5) of identical antenna elements.

Figure 1A:
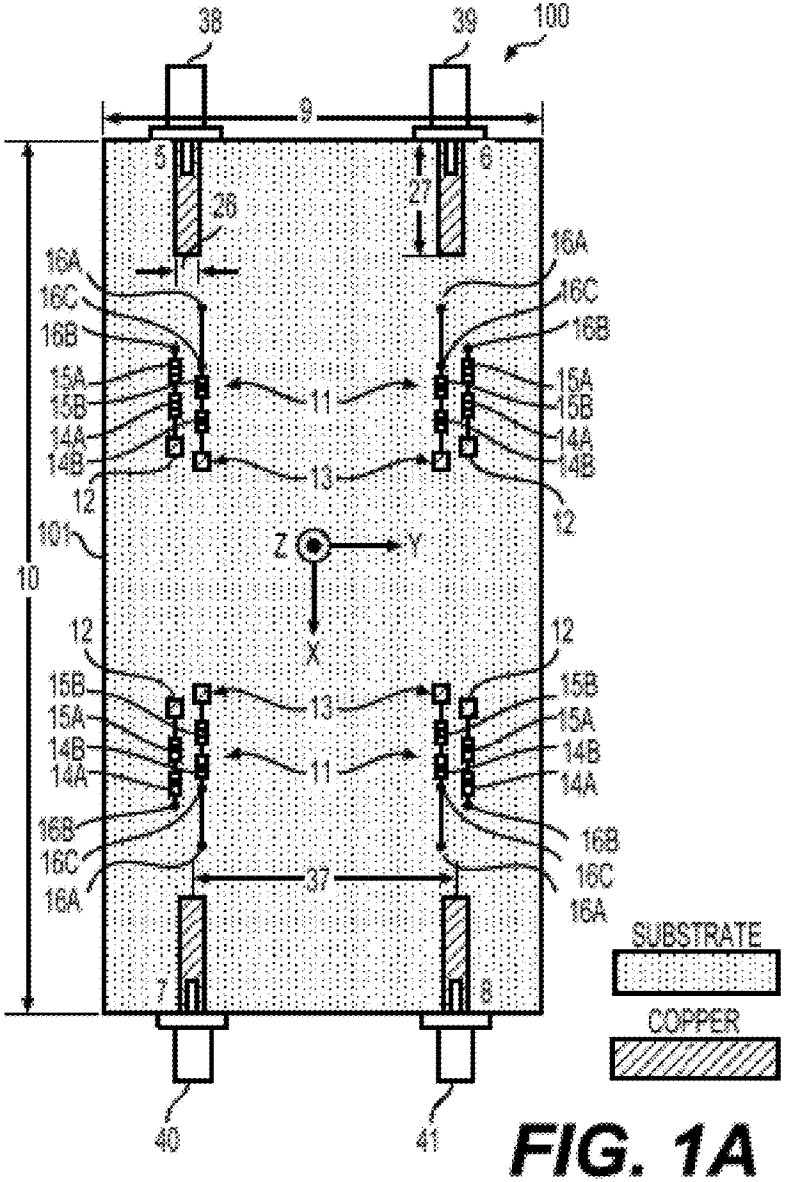
FIG. 1A is a top view of an example antenna system according to an embodiment of the disclosure.

FIG. 1A and FIG. 1B are a top view and a bottom view, respectively, of an example antenna system 100 according to an embodiment of the disclosure. The antenna system 100 can be a 4-element concentric-pentagonal-slot-based frequency agile MIMO antenna system. The top view shows four sets of varactor diode biasing circuits 11 and feed lines 5-8 on a top surface of the antenna system 100. The bottom view shows four antenna elements 1-4 on a ground (GND) plane on a bottom surface of the antenna system 100.

The antenna system 100 can be fabricated on a rectangular or square dielectric substrate 101, such as a commercially available FR-4 substrate. In one example, the antenna system 100 is fabricated using an LPKF S103 machine. In an example, the dielectric substrate 101 has a relative permittivity ($\varepsilon_r$) of 4.4 and loss tangent of 0.002. In alternative examples, the dielectric substrate 101 may have different relative permittivity or loss tangent values. For example, the relative permittivity can range typically from 1 to 10, and preferably from 3 to 5.5. The loss tangent can range typically from 0.0005 to 0.009, and preferably from 0.001 to 0.005. In one example, the rectangular dielectric substrate has a shorter edge 9 and a longer edge 10. In one example, the shorter edge 9 has a length of 60 mm, and the longer edge 10 has a length of 120 mm. In alternative examples, different ratios of shorter edge to longer edge may be adopted. In one example, the dielectric substrate has a thickness of 1.56 mm. In alternative examples, the thickness of the dielectric substrate can typically range from 0.3 mm to 3 mm, and preferably from 1 mm to 2 mm.

As shown in FIG. 1B, the antenna system 100 includes the four identical antenna elements 1-4 that are etched out of the ground (GND) plane of the dielectric substrate 101 (e.g., a copper foil covering the bottom surface of the dielectric substrate 101). The four antenna elements 1-4 can be symmetrically disposed on the top-left, top-right, bottom-left, bottom-right corners of the bottom surface of the dielectric substrate 101. For example, the top two elements 1-2 are mirror images of the bottom two elements 3-4 while the left two elements 1/3 are mirror images of the right side two elements 2/4. In alternative examples, the four antenna elements 1-4 may be asymmetrically disposed.

In one example, the antenna system 100 is customized for wireless handheld devices and mobile terminals. Accordingly, the antenna elements 1-4 are placed on the top and bottom edges of the dielectric substrate 101 to provide room for other components such as a battery and a screen.

Each antenna element 1-4 can include an inner pentagonal slot and an outer pentagonal slot that are concentric with each other. In one example, the length of each side of the outer 28 and inner 29 pentagonal slots are 14.2 mm and 8.3 mm, respectively. The dimensions and placement of both the inner and outer pentagonal slots are optimized to obtain the optimum MIMO performance of the proposed design. In alternative examples, the outer 28 and inner 29 pentagonal slots may have different dimensions. For example, corresponding to the size of 60 mm×120 mm of the substrate 101, the side length of the outer pentagonal slot 28 can range typically from 8 mm to 16 mm, and preferably from 12 mm to 16 mm; the side length of the inner pentagonal slot 28 can a range typically from 4 mm to 12 mm, and preferably from 6 mm to 10 mm.

In one example, for each antenna element 1-4, each of the five sides of the outer pentagonal slot is parallel with a respective one of the five sides of the inner pentagonal slot. In one example, one side of the outer pentagonal slot of each antenna element is parallel with a shorter edge of the dielectric substrate with a center of the respective antenna element 1-4 positioned between the one side and the shorter edge.

In one example, a distance 36 between a center of the concentric pentagonal slots of each antenna element 1-4 and a shorter edge of the dielectric substrate 101 is 20.6 mm as shown in FIG. 1B. In one example, a distance 35 between a farthest side with respect to the shorter edge of each antenna element 1-4 and the respective shorter edge of the dielectric substrate 101 is 31 mm as shown in FIG. 1B. In one example, the centers of the antenna elements 1 and 3 are aligned with a line passing center pins of the coaxial connectors 39 and 41, while the centers of the antenna elements 2 and 4 are aligned with a line passing center pins of the coaxial connectors 38 and 40. In alternative examples, the positions of each antenna element 1-4 with respect to the edge of the dielectric substrate 101 or the coaxial connectors 39-41 can be different from what is shown in FIGS. 1A-1B. For example, the distance 36 can be in a range from 15 mm and 45 mm, or preferably from 15 mm to 25 mm.

In one example, the outer pentagonal slots are first created and optimized to resonate at certain frequency, such as 3 GHz, without reactive loading to the respective slots. Then, the inner slots are introduced to obtain a tri-band antenna. Subsequently, parametric sweeps are performed to properly place varactor diodes 17-24 to effectively load both the inner and outer slots to obtain a frequency agile antenna system.

As shown in FIGS. 1A-1B, for each antenna element 1-4, three shorting pins (shorting vias) 16A/16B/16C are created through the substrate 101 for connecting respective antenna elements with varactor diode biasing circuits 11. For example, as shown in FIG. 1B (bottom view), at the antenna element 1, a first shorting pin 16A is connected to the area inside of the inner pentagonal slot, a second shorting pin 16B is connected to the area between the inner pentagonal slot and the outer pentagonal slot, and a third shorting pin 16C is connected to the area outside of the outer pentagonal slot. Thus, a first varactor diode 17 can be connected between the shorting pins 16B and 16C crossing the outer pentagonal slot of the antenna element 1, while a second varactor diode 18 can be connected between the shorting pins 16A and 16B crossing the inner pentagonal slot of the antenna element 1. The first or second varactor diode 17 or 18 can be disposed on either side of the dielectric substrate 101 in various examples. In alternative examples, more than two varactor diodes may be employed, for example, disposed on suitable positions for adding capacitance impedance to the inner and outer pentagonal slots of each antenna element. Accordingly, shorting pins more than three can be positioned at suitable locations.

As shown in FIG. 1A (top view), at the respective varactor diode biasing circuit 11 (at the top-right corner) corresponding to the antenna element 1, in one example, the shorting pins 16A and 16C are shorted. Corresponding to this scenario, one or more varactor diodes may be used for each antenna element 1-4 in different examples.

In addition, the shorting pins 16A and 16C are connected to a contact pad 13 via, for example, a resistor 14B and a inductor 15B, while the second shorting pin 16B is connected to a contact pad 12 via, for example, a resistor 14A and a inductor 15B. The resistor 14A-14B and the inductors 15A-15B form one of the varactor diode biasing circuits 11. For example, a variable voltage source can be connected between the contact pads 13 and 12 to adjust a capacitance of the varactor diode 17(18) to vary a capacitance impedance loaded to the antenna element 1. Consequently, a resonant frequency of the antenna element 1 can be changed.

Further, in alternative example, the two varactor diodes (17 and 18, 19 and 20, 21 and 22, or 23 and 24) can be biased with two separate biasing circuits. The two varactor diodes may be different or the same. Accordingly, structures of the respective two separate biasing circuits may be the same or different, and the respective biasing voltages may be from the same or different voltage sources.

In the example shown in FIG. 1B, the two varactor diodes of each antenna elements are shown to be positioned across the respective inner and outer pentagonal slots. However, in other examples, one or two varactor diodes for loading one of the four antenna elements may be disposed in any other suitable locations, and can be connected to the shorting pins 16A/16B/16C via conductive media, such as copper lines, microstrips, and the like.

For antenna elements 3-5, the varactor diodes 19-24 and associated shorting pins 16A/16/B/16C and varactor biasing circuits 11 can be configured similarly as that of the antenna element 1.

As shown in FIG. 1A, in one example, four coaxial connectors 38-41 (e.g., subminiature version A connectors) are disposed on the shorter edges of the dielectric substrate 101. The microstrip feed lines 5, 6, 7, 8 in FIG. 1A are disposed on the top surface of the antenna system 100, and connected with center pins of the respective coaxial connectors 38-40 to feed the four antenna elements 1-4. Each microstrip feed line 5-8 can extend from the top or bottom edge to a position above the area inside of the inner pentagonal slot at each antenna element 6-8. In some examples, each microstrip feed line 5-8 can be identical, and having a length 27 of 15.8 mm and a width of 3 mm. In one example, a distance 37 between the center pins of the coaxial connectors 5 and 6, or 7 and 8 is 36 mm.

As shown in FIG. 2B, in one example, a defected ground structure (DGS) 25 is introduced between two adjacent antenna elements 1 and 2, or 3 and 4, to isolate a mutual coupling between the two adjacent antenna elements. The dimensions of each DGS 25 are given as 30 (1 mm), 31 (4 mm), 32 (25 mm), 33 (12 mm), 34 (4 mm) in one example. In alternative example, the DGS 25 may have different structures. In one example, as shown in FIG. 1B, the DGS 25 can include two parallel slots extending from a patch adjacent to a shorter edge of the dielectric substrate 101. The patch can be etched out of the ground plane. In one example, there is different number of slots extending from the respective shorter edge. In one example, slots extending from the shorter edge can have different shapes other than what is shown in FIG. 1B.

Figure 2:
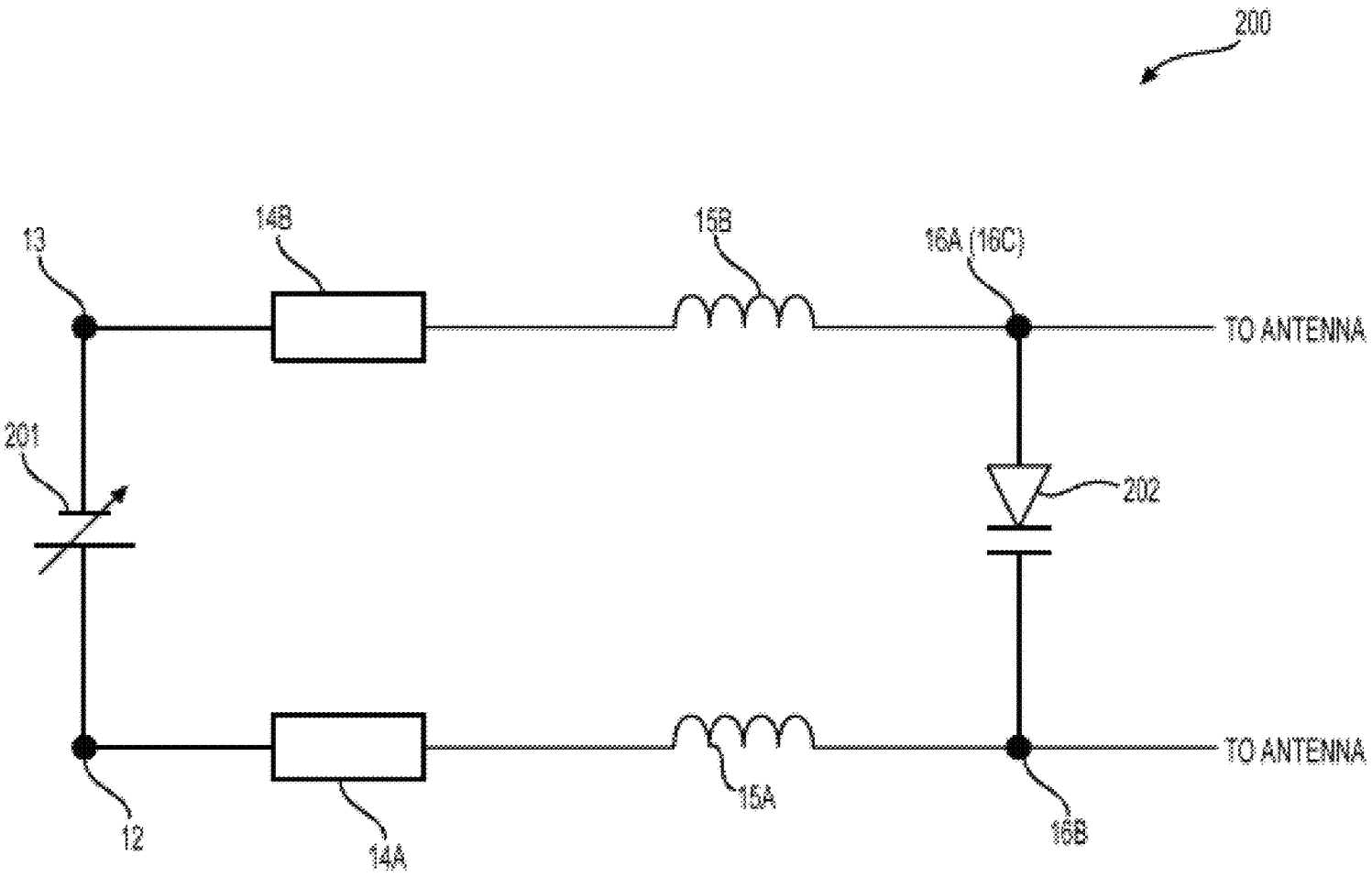
FIG. 2 shows an example varactor diode biasing circuit according to an embodiment of the disclosure.

FIG. 2 shows an example varactor diode biasing circuit 200 according to an embodiment of the disclosure. As shown, the resistor 14B and the inductor 15B are connected between the contact pad 13 and the shorting pin 16A and/or 16C. The resistor 14A and the inductor 15A are connected between the contact pad 12 and the shorting pin 16B. A variable voltage source 201 is connected between the contact pads 12 and 13. A varactor diode 202 is connected between the shorting pins 16A(16C) and 16B, and is reverse biased by the biasing circuit 200. By varying the voltage source 201, a reverse bias voltage on the varactor diode 202 can be varied. Accordingly, a capacitance of the varactor diode 202 can be adjusted, changing a capacitance impedance loaded to one of the antenna elements 1-4.

In one example, similar biasing circuits 200 can be used for biasing the varactor diodes 17-24 associated with each antenna elements 1-4. The variable voltage 210 can be applied to the 4 antenna elements 1-4 simultaneously. When varying the variable voltage 210, a resonant frequency of the antenna system 100 can be accordingly changed. In one example, the inductor 15A or 15B has an inductance of 1 μH, and the resistor 14A or 14B has a resistance of 2.1 kΩ. In one example, the varactor diodes 17-24 are SMV 1233 varactor diodes.

Figure 4:
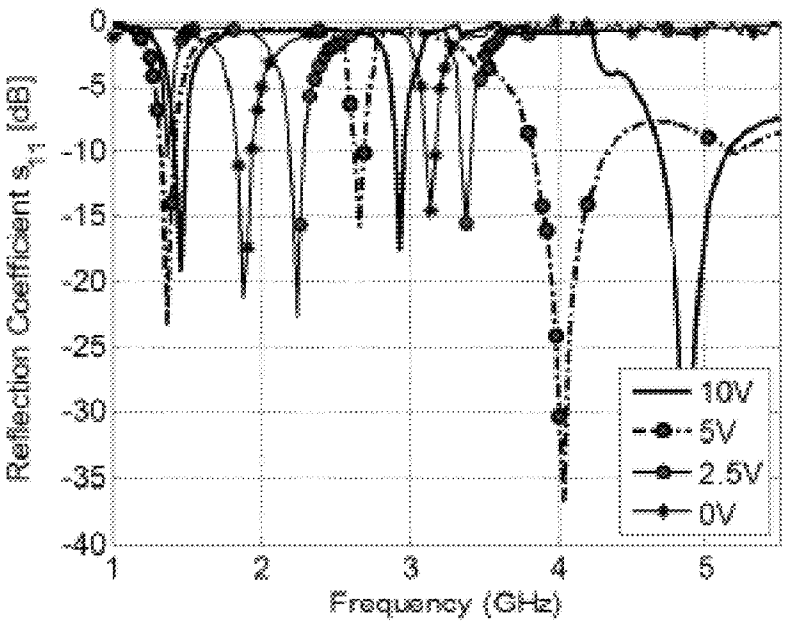
FIG. 4 shows results of measurements of an embodiment of the antenna system.
Figure 3:
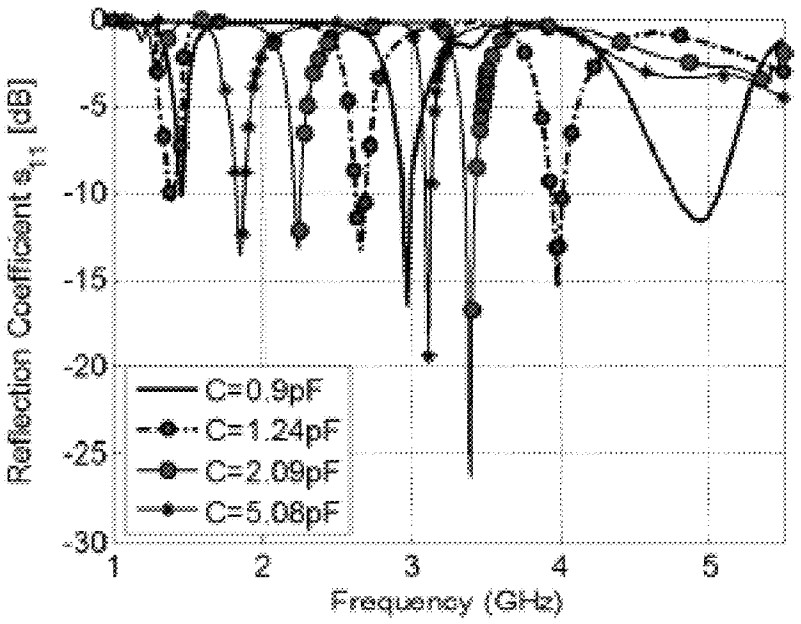
FIG. 3 shows results of a simulation of an experimental process.

In one experimental process of operating an embodiment of the antenna system 100, two varactor diodes are used for each antenna element 1-4, and one varactor diode biasing circuit is used for each antenna element 1-4 to add a varactor diode reverse bias voltage to two respective varactor diodes. The varactor diode bias voltages of the four antenna elements are simultaneously varied between 0~15 volts. The capacitances of each varactor diode of the four antenna elements are simultaneously varied from 0.9 pF to 5.08 pF. FIG. 3 shows results of a simulation of the experimental process, while FIG. 4 shows results of measurements of the embodiment antenna system. Both FIG. 3 and FIG. 4 show multiple curves of reflection coefficients changing along different operating frequencies. The curves of FIG. 3 correspond to different varactor diode capacitances. The curves of FIG. 4 correspond to different varactor diode biasing voltages.

As shown, the capacitance of the respective varactor diodes has a significant effect on the resonant frequency of the respective antenna system. The resonant frequency of the respective antenna system (corresponding to a series of extreme values of the respective curves shown in FIGS. 3-4) is smoothly changed over a wide frequency band 1.32 to 5.2 GHz when the varactor diode capacitance or biasing voltage changes. A significant operating bandwidth is achieved at the resonant band. For example, a minimum −6 dB operating bandwidth is 50 MHz corresponding to the frequency band 1.32 to 5.2 GHz.

Figure 6:
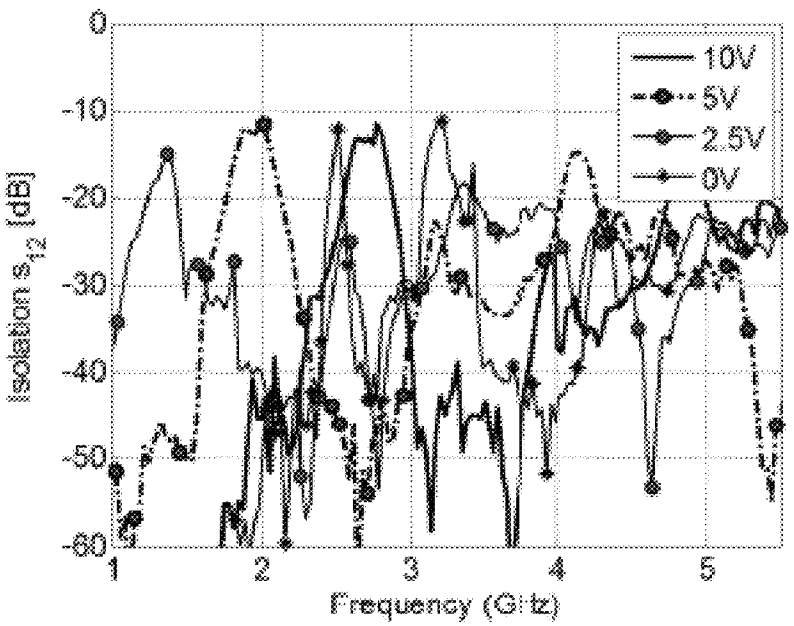
FIG. 6 shows measured isolation curves corresponding to the experimental process.
Figure 5:
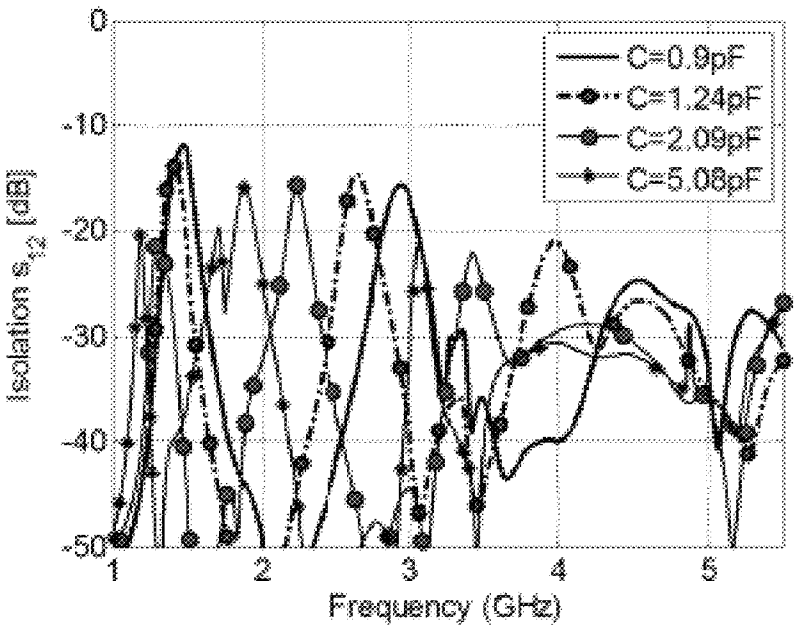
FIG. 5 shows simulated isolation curves corresponding to the experimental process.

FIG. 5 and FIG. 6 show simulated and measured isolation curves corresponding to the above experimental process. As shown, the isolation corresponding to respective resonant frequency can be in the range between −10 dB and −30 dB within the operating frequency band 1.32 to 5.2 GHz. In addition, an envelope correlation coefficient (ECC) between radiation patterns of the antenna elements is smaller than 0.186 in the operating bands shown in FIGS. 4 and 5. A maximum measured gain of the antenna elements of 4.5 dBi with a maximum efficiency of 81% is obtained in the above experimental process.

In the work of Deepali K. Borakhade, et al., Pentagon Slot Resonator Frequency Reconfigurable Antenna for Wideband Reconfiguration, single element dual and triple concentric slot based antennas are presented. The antennas, referred to as Deepali antennas, are made reconfigurable using PIN diodes. For two slots antenna structure, two frequency bands with center frequencies at 1.54 GHz and 2.62 GHZ are covered while in the case of 3-slots antenna structure, the frequency bands covered are with center frequencies at 1.32 GHz, 1.68 GHz and 2.54 GHz. The antennas are fabricated on FR4 substrate.

Regarding the operating bands and resonant frequency reconfigurability, most of the operating bands covered by the Deepali antennas are overlapping and the frequency reconfigurability achieved in the Deepali antennas is not effective compared with the 4-element antenna disclosed herein. In addition, fewer distinct bands are achieved using slot antenna with PIN diode reconfigurablility compared with the 4-element antenna disclosed herein.

In contrast, each element antenna of the 4-element antenna disclosed herein is improved in structure. In one example, each single element antenna provides ultra-wideband tuning of resonance frequencies, for example, from 1.32~1.49 GHz and 1.75~5.2 GHz. In addition, the Deepali antennas do not cover any band beyond 2.78 GHz.

In addition, in modern wireless communication system, MIMO antenna systems are highly desirable to meet high date rate and reliable communication requirements. For example, MIMO antenna systems offer high quality of service (QoS) with increased spectral efficiency. MIMO antenna systems can be employed to obtain a wider coverage compared with single element antenna systems. The 4-element antenna system disclosed herein can fulfill functions of a MIMO antenna system, and provide advantages lacked in the Deepali antennas that are single element antenna systems.

In single element antenna design, isolation/mutual coupling is irrelevant, while in 4-element antenna design, it is important to consider the mutual coupling between closely spaced neighboring antenna elements. The neighboring antenna elements are preferably isolated to serve as different MIMO communication channels. Accordingly, the DGS 25 can be employed to reduce the mutual coupling between the two closely spaced antenna elements.

Additionally, in MIMO antenna design, it is important to place MIMO antenna elements to have a better-input impedance matching. Radiation patterns of neighboring antenna elements should ideally be orthogonal. Those requirements are not considered for a single element antenna. For example, in MIMO antenna design, MIMO performance metrics, such isolation, envelop correlation coefficient (ECC), and total active reflection coefficients (TARC), and the like, are analyzed and validated. However, analysis to those parameters is not required for single element antenna design.

While aspects of the present disclosure have been described in conjunction with the specific embodiments thereof that are proposed as examples, alternatives, modifications, and variations to the examples may be made. Accordingly, embodiments as set forth herein are intended to be illustrative and not limiting. There are changes that may be made without departing from the scope of the claims set forth below.

What is claimed is:

1. An antenna system, comprising:

a rectangular dielectric substrate having a bottom surface that is covered by a ground plane, and a top surface;

four identical antenna elements symmetrically distributed on each corner of the bottom surface, each antenna element having a concentric-pentagonal-slot-based structure that is etched out of the ground plane, and includes an outer pentagonal slot and an inner pentagonal slot, each side of the outer pentagonal slot parallel with a corresponding side of the inner pentagonal slot, wherein one side of the outer pentagonal slot of each antenna element is parallel with a shorter edge of the rectangular dielectric substrate with a center of the respective antenna element positioned between the one side and the shorter edge; and a first and a second varactor diode for each of the four antenna elements, the first varactor diode disposed across the one side of the outer pentagonal slot of the respective antenna element, the second varactor diode disposed across the side of the inner pentagonal slot of the respective antenna element that is parallel with the one side.

2. The antenna system of claim 1, further comprising:

two defected ground structures (DGS) each disposed between two antenna elements disposed along the shorter edge of the rectangular dielectric substrate, and etched out of the ground plane.

3. The antenna system of claim 2, wherein each of the two DGS comprises:

two parallel slots extending away from a patch positioned at the respective shorter edge.

4. The antenna system of claim 1, wherein the dielectric substrate is an FR-4 substrate with a relative permittivity of 4.4 and a loss tangent of 0.002.

5. The antenna system of claim 1, wherein the dielectric substrate have a size of 60×120 $mm^2$.

6. The antenna system of claim 1, wherein the inner diagonal slot has a side length of 8.3 mm, and the outer diagonal slot has a side length of 14.2 mm.

7. The antenna system of claim 1, wherein a distance between a center of the concentric-diagonal-slot-based structure of each antenna element and the shorter edge of the rectangular dielectric substrate is 20.6 mm.

8. The antenna system of claim 1, wherein a resonant frequency of the antenna system is configured to change over a frequency band from 1.32 GHz to 5.2 GHz with a minimum −6 dB bandwidth of 50 MHz.

9. An antenna system, comprising:

a rectangular dielectric substrate having a bottom surface that is covered by a ground plane, and a top surface;

four identical antenna elements symmetrically distributed on each corner of the bottom surface, each antenna element having a concentric-pentagonal-slot-based structure that is etched out of the ground plane, and includes an outer pentagonal slot and an inner pentagonal slot, each side of the outer pentagonal slot parallel with a corresponding side of the inner pentagonal slot, wherein one side of the outer pentagonal slot of each antenna element is parallel with a shorter edge of the rectangular dielectric substrate with a center of the respective antenna element positioned between the one side and the shorter edge; and a varactor diode for each of the four antenna elements, a capacitance of the varactor diode loaded across the one side of the outer pentagonal slot of the respective antenna element, and the side of the inner pentagonal slot of the respective antenna element that is parallel with the one side.

10. An antenna system, comprising:

a rectangular dielectric substrate having a bottom surface that is covered by a ground plane, and a top surface;

four identical antenna elements symmetrically distributed on each corner of the bottom surface, each antenna element having a concentric-pentagonal-slot-based structure that is etched out of the ground plane, and includes an outer pentagonal slot and an inner pentagonal slot, each side of the outer pentagonal slot parallel with a corresponding side of the inner pentagonal slot, wherein one side of the outer pentagonal slot of each antenna element is parallel with a shorter edge of the rectangular dielectric substrate with a center of the respective antenna element positioned between the one side and the shorter edge; and four microstrip feed lines on the top surface corresponding to each antenna elements, wherein each of the four microstrip feed lines extends from the shorter edge of the rectangular dielectric substrate and reaches a position above an area within the inner pentagonal slot.

* * * * *